US006382457B1

(12) United States Patent
Bernard et al.

(10) Patent No.: US 6,382,457 B1
(45) Date of Patent: May 7, 2002

(54) REINFORCED WALL STRUCTURE FOR CONTAINER

(75) Inventors: Pierre Bernard, Pierrefonds; François Géelinas; Marc Julien, both of Montreal, all of (CA)

(73) Assignee: Solutions Jupiter Inc., Dorval (CA)

( * ) Notice: Subject to any disclaimer, the term of this patent is extended or adjusted under 35 U.S.C. 154(b) by 0 days.

(21) Appl. No.: 09/664,787

(22) Filed: Sep. 19, 2000

(51) Int. Cl.[7] ..... B65D 1/42; B65D 6/34

(52) U.S. Cl. ..... 220/651; 220/646; 220/650; 220/1.5

(58) Field of Search ..... 220/650, 646, 220/647, 651, 1.5

(56) References Cited

U.S. PATENT DOCUMENTS 1,044,667 A * 11/1912 Lachman ..... 220/639
2,322,704 A * 6/1943 Seltzer ..... 220/650
4,094,430 A * 6/1978 Cauley ..... 220/646
5,205,428 A * 4/1993 Yurgevich et al. ..... 220/1.5
5,348,176 A * 9/1994 Yurgevich et al. ..... 220/1.5

FOREIGN PATENT DOCUMENTS

GB 137024 * 12/1919 ..... 220/646

OTHER PUBLICATIONS

Onan Cummins—Generator set Catalogue—Powerful Solutions—Minneapolis, MN 55432 (1998).

* cited by examiner

*Primary Examiner*—Joseph M. Moy
(74) *Attorney, Agent, or Firm*—Francois Martineau

(57) ABSTRACT

The container includes a floor panel, two side walls, two end walls, and a ceiling panel. The two side walls are made from a corrugated metallic sheet, defining flat wall portions with vertical ribs being formed between two successive flat wall portions. The ribs have inwardly oriented concave surfaces, and elongated rigid reinforcement strips are welded to the side wall panels in facing register with each rib concave surface.

14 Claims, 4 Drawing Sheets

82
86
88
90
80
84
16
92
82

REINFORCED WALL STRUCTURE FOR CONTAINER

FIELD OF THE INVENTION

The present invention relates to containers such as containers for carrying power generators, and more particularly to a reinforced wall structure for such containers.

BACKGROUND OF THE INVENTION

It is known to provide corrugated wall structures for containers, to reinforce their structural integrity. Indeed, large containers may be loaded with heavy equipment, and the stresses which will be induced in their wall structure may be very important. A conventional corrugated wall structure includes a flat metallic panel which is bent into a corrugated form. That is to say, at regular intervals along the wall panel, the flat wall panel will include a bent portion which will form an outwardly protruding rib vertically disposed on the container wall.

Such a corrugated form for containers is useful in the field of high-output mobile power generator units, in which a high-output power generating motor assembly including a motor, a flywheel, a drive, a muffler, exhaust pipes, a fuel tank, a cooling radiator, cooling fans, and other elements known in the art, is carried inside a container usually in the form of a semi-trailer container which can be carried by a tow-truck. The known purpose of mobile power generator units is to provide power to electric grid portions which suffer from power shortage, which do not have access to other conventional power sources, or as a fall-back option for conventional electric grids in addition to other conventional power sources. The elements carried by the semi-trailer container are very heavy, and the loads and stresses induced thereby can exceed the structural resistance limits of usual corrugated containers, or at least can exceed the allowed limits according to certification organizations. These exceeded structural resistance limits of the semi-trailer containers occur since the wall structure of the semi-trailer container is weakened by the presence of a number of openings made therein. These openings are essential to the working of the mobile power generator, and include for example the following openings: fresh air intake ports for the cooling radiators, for the flywheel, and for the motor; maintenance doors allowing access to different parts of the mobile generator unit; warm air outlet ports allowing warm air to be exhausted from within the mobile generator unit; gas inlet port; etc . . .

This problem is emphasized when the semi-trailer container has to be carried over ground with a lifting mechanism such as a crane, for example when loading the semi-trailer container in a boat for overseas shipping. Indeed, unusual stresses will then be incurred in the semi-trailer container wall structure, apart from the usual gravity-borne stresses. The semi-trailer container will be subjected to torsion and flexing stresses that may well permanently damage its wall structure, due to the crane lifting the semi-trailer container with cables which hook onto comer castings provided on the top portion of the semi-trailer container, and important stresses will then result on the semi-trailer container, and more particularly on its wall panels, at other areas than on its conventionally reinforced floor panel.

One way to circumvent this problem is to provide thicker wall panels, but this is a highly undesirable option, since the overall weight of the container is then significantly increased.

OBJECTS OF THE INVENTION

It is therefore an object of the present invention to provide a resistant yet simple wall structure for containers.

It is another object of the present invention to provide a resistant wall structure specifically for containers used in mobile power generator units.

It is another object of the present invention to provide a resistant yet relatively light-weight wall structure for containers.

SUMMARY OF THE INVENTION

The present invention relates to a container for carrying heavy equipment therein defining an upper and a lower end, and comprising a floor panel at said lower end and a peripheral wall upstanding from said floor panel and fixedly attached thereto, said peripheral wall enclosing an inner chamber and being made from at least one rigid corrugated sheet of material, said at least one corrugated sheet having a number of spaced-apart, vertically extending ribs each defining a concave surface and a convex surface, wherein each said at least one corrugated sheet has a number of elongated rigid reinforcement strips each vertically fixedly attached to said corrugated sheet in facing register with the concave surface of a corresponding said rib.

Preferably, all said rib concave surfaces are oriented towards said inner chamber.

Preferably, said peripheral wall panel comprises flat wall panel portions between which said ribs are located, each said rib being defined by a pair of parallel, spaced-apart flanking wall portions outwardly and integrally extending from two sequentially adjacent said flat wall panel portions, and an end wall portion transversal to and integrally linking said flanking wall portions at outer end portions thereof, a number of said flat wall panel portions being made integrally with corresponding flanking wall portions and end wall portions from a bent sheet of metallic material.

Preferably, each said flanking wall portion extends outwardly and perpendicularly from a corresponding side wall portion, and wherein each said end wall portion perpendicularly bridges two corresponding flanking wall portions at said outer end portions thereof.

Preferably, each said reinforcement strip extends for the full length of a corresponding said rib.

Preferably, each said reinforcement strip is made from the same metallic material as said bent sheet of metallic material.

Preferably, each said reinforcement strip is welded to said sheet of metallic material on each side of a corresponding said rib.

Preferably, each said reinforcement strip is welded to said sheet of metallic material with welding seams.

Preferably, said strip defines two longitudinal edges, and wherein said welding seams occupy 33% of the length of each longitudinal edge of each strip.

Preferably, each said rib is provided with a corresponding reinforcement strip.

The present invention further relates to a mobile power generator unit comprising a movable container for use in carrying a power generating motor assembly, said container defining an upper and a lower end and including a floor panel at said lower end for supporting said power generating motor assembly, a peripheral wall upstanding from and fixedly attached to said floor panel and enclosing an inner chamber for containing said power generating motor assembly, and a ceiling panel attached to said peripheral wall at said upper end of said container, said peripheral wall including:

a number of corrugated wall panels each made from a bent sheet of material and defining a number of spaced-apart, vertically extending ribs each defining a concave surface and an opposite convex surface;

a number of rigid elongated reinforcement strips each vertically fixedly attached to a said corrugated wall panel in facing register with the concave surface of a corresponding said rib.

Preferably, said container peripheral is generally rectangular and comprises two sides each formed with a said corrugated wall panel, and an end wall and a front wall.

DETAILED DESCRIPTION OF THE EMBODIMENTS

Figure 1:
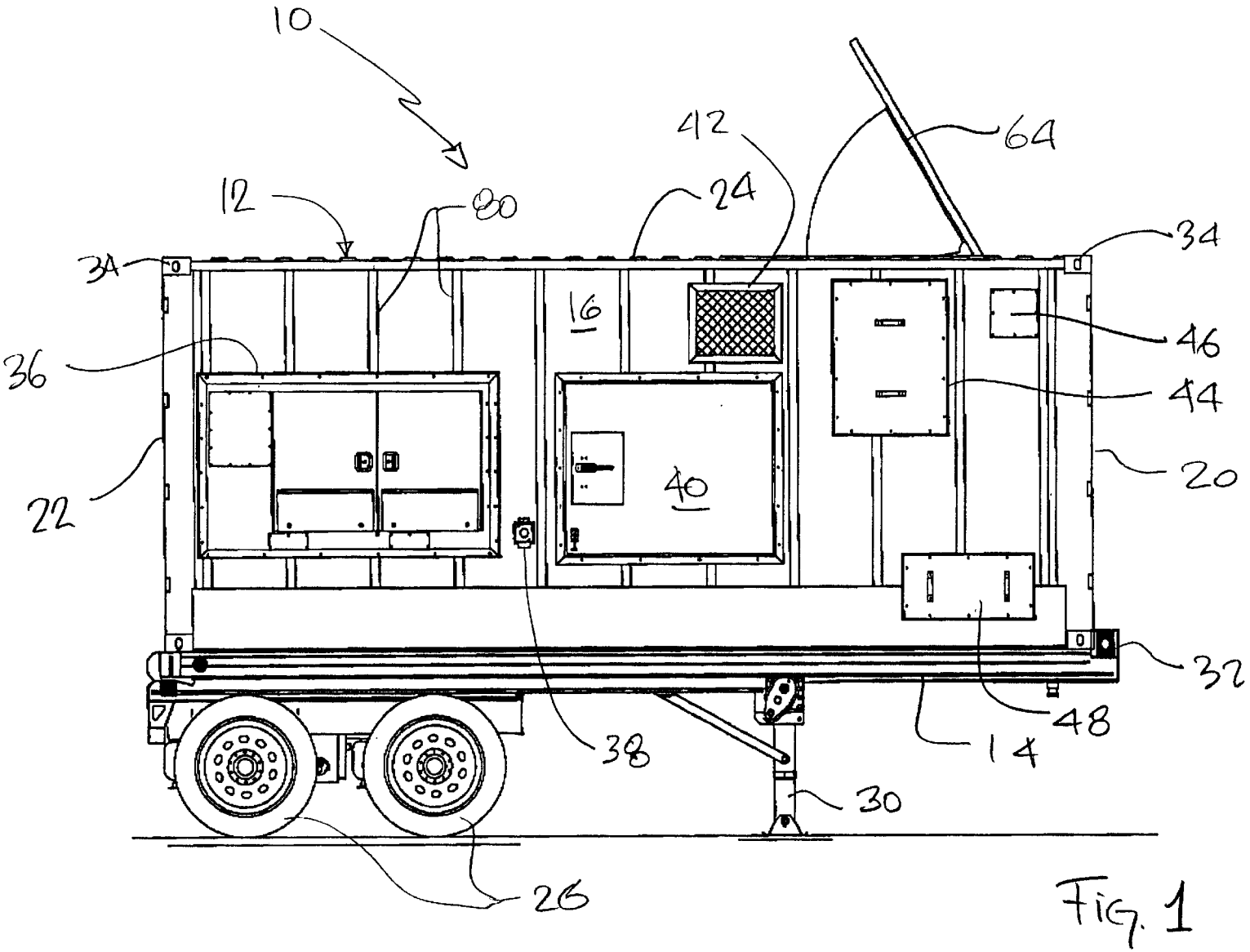
FIGS. 1 and 2 are side elevations respectively of a first side and a second side of a mobile generator unit having a reinforced wall structure according to the present invention.
Figure 3:
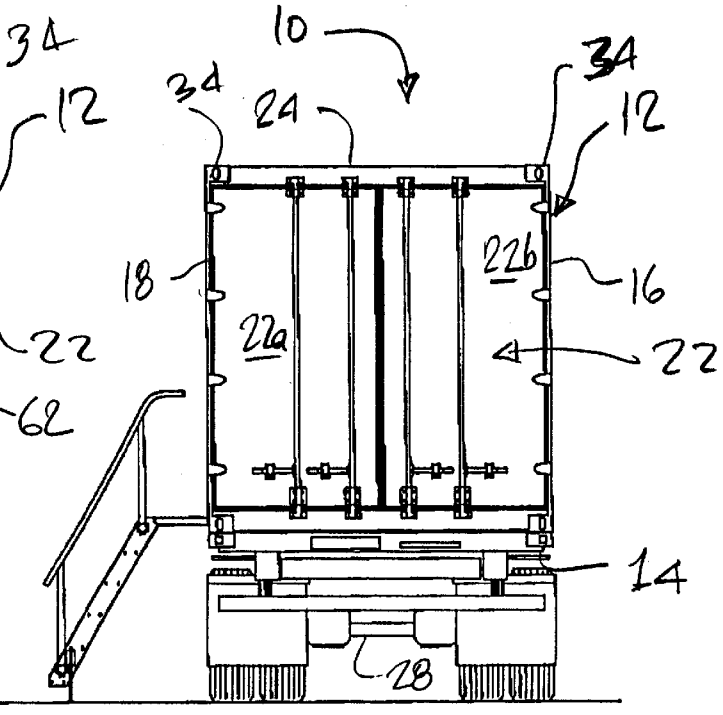
FIGS. 3 and 4 are respectively a rear elevation and a top plan view of the mobile generator unit of FIG. 1.

FIGS. 1–4 show a mobile generator unit 10. Mobile generator unit 10 includes a container 12 in the form of a semi-trailer container 12 which has a floor panel 14; a peripheral wall enclosing an inner chamber and including first and second side wall panels 16, 18, a front wall panel 20 and a rear wall panel 22 forming a pair of rear access doors 22*a*, 22*b* allowing access into the container inner chamber; and a ceiling panel 24. Front panel 20 also has a pair of doors, with only one door 20*a* being shown in the drawings, which can be opened to allow a fresh air intake through a fresh air intake port (not shown) partly covered by acoustic louvers (not shown), as known in the art. Floor 14 is reinforced in a conventional manner, inter alia with transversely installed I-beams.

Semi-trailer container 12 is carried over ground by wheels 26 mounted by pairs on axles 28. A pivotable front arm 30 allows container 12 to be maintained in a horizontal condition when it is not being moved, and a front tow hitch 32 allows container 12 to be attached to a truck to carry it between different locations. Corner castings 34 engageable by hooks from a crane are provided on the upper comers of container 12, for example for use when loading the container 12 on a boat.

Figure 2:
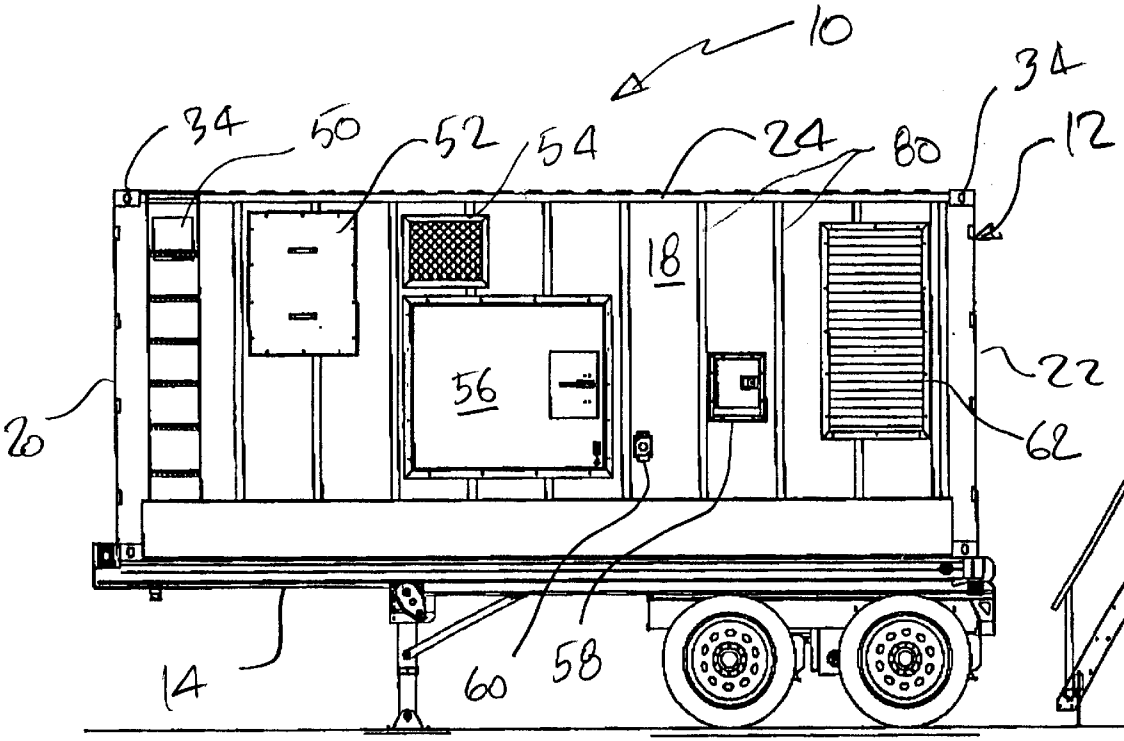
Figure 4:
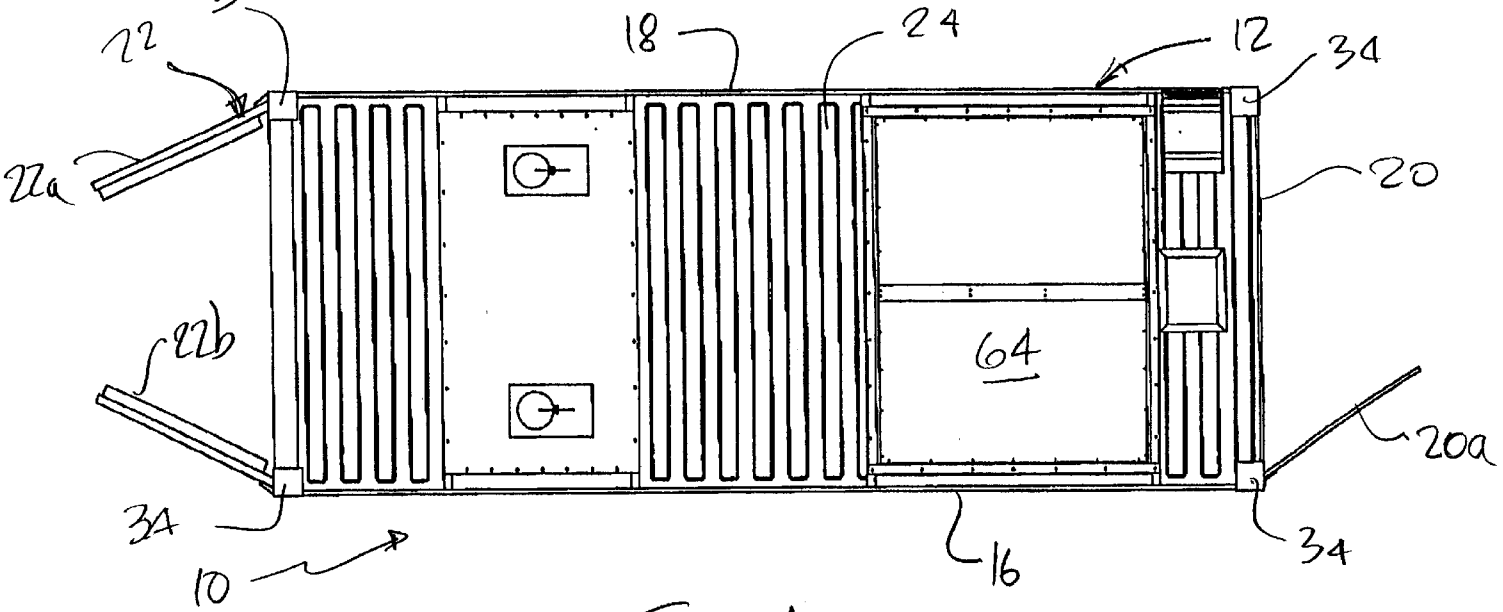

FIG. 1 shows that the first side wall panel 16 of container 12 comprises a number of openings, which are used to fit the following known elements: a breaker box 36, an emergency stop control button 38, a motor service access door 40, a motor air intake port 42 covered by a screen, a hydraulic cylinder service access door 44, a radiator sensor access trap 46, and a radiator pipe service access door 48. FIG. 2 shows that the second side wall panel 18 of container 12 comprises a number of openings, which are used to fit the following known elements: a window 50 for visual inspection of the level of cooling fluids, a hydraulic cylinder service access door 52, a motor air intake port 54 covered by a screen, a motor service access door 56, a fuel tank refilling inlet access door 58, an emergency stop control button 60, and a cooling fresh air intake port 62 for the alternator covered with acoustic louvers. FIGS. 1 and 4 show that a warm air outlet port (concealed in the drawings) with a closable door 64 therefor, are provided on the ceiling panel of container 12.

It can consequently be seen that a number of openings are made in container 12, and more specifically in the container peripheral wall 16, 18, 20, 22. These openings are compulsory for a proper use of power generator unit 10, but structurally weaken container 12 considerably.

Figure 5:
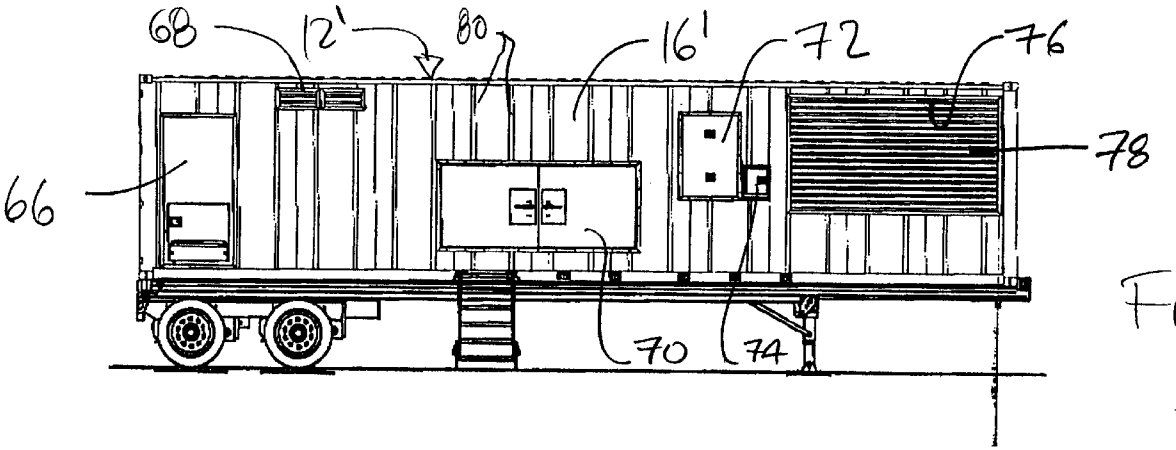
FIG. 5 is a side elevation of an alternate mobile generator unit having a reinforced wall structure according to the present invention.

A container 12' similar to container 12 but of longer configuration, is shown in FIG. 5. It can be seen that container 12' also includes a number of openings in its side wall 16', for fitting therein a breaker panel 66, a motor air intake 68, a motor service access door 70, a cooling fan service access door 72, a fuel tank refilling inlet access door 74, and a fresh air intake port 76 covered by an acoustic louver 78. These openings again structurally weaken container 12'.

Figures 6, 7:
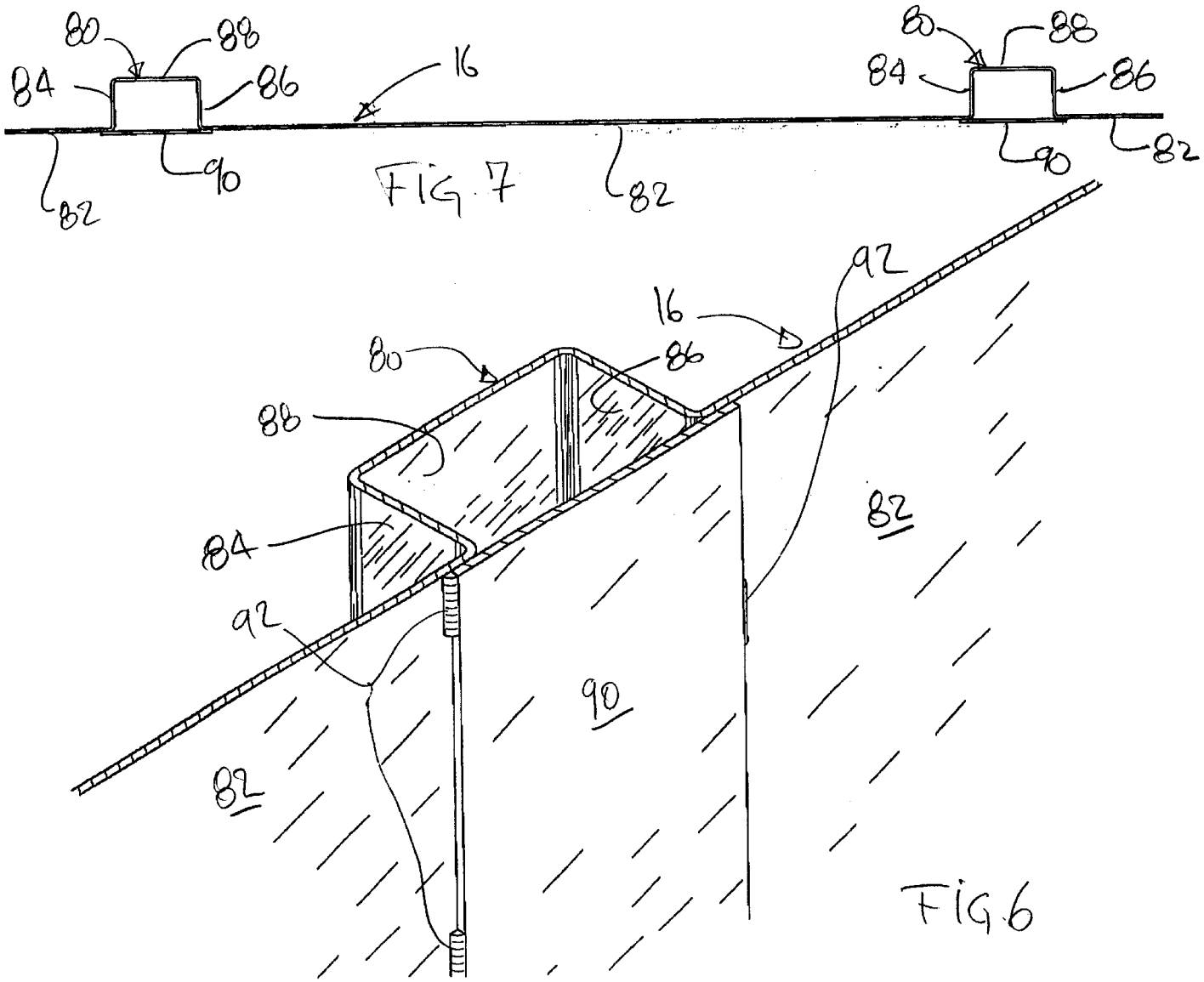
FIG. 6 is en enlarged perspective view of a portion of the reinforced wall structure of the mobile generator unit of FIGS. 1–4 and of the alternate mobile generator unit of FIG. 5.
FIG. 7 is an enlarged cross-sectional view of the reinforced wall structure of the mobile generator unit of FIGS. 1–4 and of the alternate mobile generator unit of FIG. 5.

As shown in FIGS. 6 and 7, and according to the present invention, each one of the side wall panels 16, 18 of container 12 (as are those of container 12'), for example lateral side wall panel 16, is made from a corrugated sheet of metal which is bent so as to define vertical ribs 80 therein. Side wall panel 16 thus defines flat wall panel portions 82 which are interrupted by a number of spaced ribs 80, with the ribs comprising a pair of parallel, spaced-apart flanking wall portions 84, 86 outwardly and integrally extending from two successive flat wall panel portions 82, 82, and an end wall portion 88 transversal to and integrally linking the flanking wall portions 84, 86 at outer end portions thereof.

Each rib 80 defines an inwardly oriented concave surface and an outwardly oriented convex surface, i.e. its concave surface is oriented towards the container inner chamber. Rib 80 more particularly is formed from a flanking wall portions 84, 86 extending outwardly and perpendicularly from their corresponding flat wall panel portions 82, 82, and end wall portion 88 perpendicularly bridging the two corresponding flanking wall portions 84, 86 at the outer end portions thereof.

According to the present invention, there is provided an elongated reinforcement strip 90 in facing register with each rib concave surface, the reinforcement strips 90 being vertically fixedly attached to the flat wall panel portions 82, 82 on each side of their corresponding ribs 80 and extending for the full length thereof. Each strip is made from a flat sheet of a same metallic material as that of wall 16. Each strip 90 is welded to flat wall panel portions 82, 82 with welding seams 92. Preferably, welding seams of a length of one inch (2.5 centimeters) are made, with a two inch (five centimeter) gap between two successive welding seams. Seams 92 are further preferably arranged in a staggered configuration on each side of strip 90. Thus, approximately 33% of each side edge of strip 90 is preferably welded to flat wall panel portions 82, 82.

We claim:

1. A container for carrying heavy equipment therein defining an upper and a lower end, and comprising a floor panel at said lower end and a peripheral wall upstanding from said floor panel and fixedly attached thereto, said peripheral wall enclosing an inner chamber and being made from at least one rigid corrugated sheet of material, said at least one corrugated sheet having a number of spaced-apart, vertically extending elongated ribs each defining a concave surface oriented towards said inner chamber and a convex surface opposite said concave surface, wherein each said at least one corrugated sheet has a number of elongated rigid flat reinforcement strips each vertically fixedly attached to said corrugated sheet inside said container inner chamber in longitudinal facing register with the concave surface of a corresponding said rib and extending the full length of said rib, with each said rib being provided with a distinct corresponding said strip.

2. A container as defined in claim 1, wherein said peripheral wall panel comprises flat wall panel portions between which said ribs are located, each said rib being defined by a pair of parallel, spaced-apart flanking wall portions outwardly and integrally extending from two sequentially adjacent said flat wall panel portions, and an end wall portion transversal to and integrally linking said flanking wall portions at outer end portions thereof, a number of said flat wall panel portions being made integrally with corresponding flanking wall portions and end wall portions from a bent sheet of metallic material.

3. A container as defined in claim 2, wherein each said flanking wall portion extends outwardly and perpendicularly from a corresponding side wall portion, and wherein each said end wall portion perpendicularly bridges two corresponding flanking wall portions at said outer end portions thereof.

4. A container as defined in claim 3, wherein each said reinforcement strip is made from the same metallic material as said bent sheet of metallic material.

5. A container as defined in claim 4, wherein each said reinforcement strip is welded to said sheet of metallic material on each side of a corresponding said rib.

6. A container as defined in claim 5, wherein each said reinforcement strip is welded to said sheet of metallic material with welding seams.

7. A container as defined in claim 6, wherein said strip defines two longitudinal edges, and wherein said welding seams occupy 33% of the length of each longitudinal edge of each strip.

8. A mobile power generator unit comprising a movable container for use in carrying a power generating motor assembly, said container defining an upper and a lower end and including a floor panel at said lower end for supporting said power generating motor assembly, a peripheral wall upstanding from and fixedly attached to said floor panel and enclosing an inner chamber for containing said power generating motor assembly, and a ceiling panel attached to said peripheral wall at said upper end of said container, said peripheral wall including:

a number of corrugated wall panels each made from a bent sheet of material and defining a number of spaced-apart, vertically extending elongated ribs each defining a concave surface oriented towards said inner chamber and a convex surface opposite said concave surface;

a number of rigid elongated flat reinforcement strips each vertically fixedly attached to said corrugated wall panel inside said container inner chamber in longitudinal facing register with the concave surface of a corresponding said rib and extending the full length of said corresponding rib, with each said rib being provided with a distinct corresponding said strip.

9. A container as defined in claim 8, wherein each said rib is defined by a pair of parallel, spaced-apart flanking wall portions outwardly and integrally extending from two successive said flat wall panel portions, and an end wall portion transversal to and integrally linking said flanking wall portions at outer end portions thereof.

10. A container as defined in claim 9, wherein each said flanking wall portion extends outwardly and perpendicularly from a corresponding flat wall portion, and wherein each said end wall portion perpendicularly bridges two corresponding flanking wall portions at said outer end portions thereof.

11. A container as defined in claim 10, wherein said corrugated wall panels and said reinforcement strips are made from a same metallic material.

12. A container as defined in claim 11, wherein each said reinforcement strip is welded to said sheet of metallic material on each side of a corresponding said rib with welding seams.

13. A container as defined in claim 12, wherein said welding seams occupy 33% of the length of each edge of each strip.

14. A container as defined in claim 13, wherein said container peripheral is generally rectangular and comprises two sides each formed with a said corrugated wall panel, and an end wall and a front wall.

* * * * *